United States Patent [19]

Martin et al.

[11] Patent Number: 5,038,744

[45] Date of Patent: Aug. 13, 1991

[54] METHOD AND APPARATUS FOR CONTROLLING SPARK IGNITION IN AN INTERNAL COMBUSTION ENGINE

[75] Inventors: Jay K. Martin, Madison, Wis.; Peter G. Hartman, Worcester, Mass.; Steven L. Plee; Donald J. Remboski, Jr., both of Northborough, Mass.

[73] Assignee: Barrack Technology Limited, Perth, Australia

[21] Appl. No.: 541,600

[22] Filed: Jun. 21, 1990

[51] Int. Cl.[5] ..... F02P 9/00

[52] U.S. Cl. ..... 123/625; 123/637

[58] Field of Search ..... 123/425, 625, 626, 636, 123/637, 638

[56] References Cited

U.S. PATENT DOCUMENTS

| | | | |
|---|---|---|---|
| 3,620,201 | 11/1971 | Warren et al. | 123/637 |
| 3,898,971 | 8/1975 | Lefevre | 123/598 |
| 3,926,165 | 12/1975 | Merrick | 123/636 |
| 4,164,912 | 8/1979 | Beyler | 123/26 |
| 4,181,112 | 1/1980 | Grather et al. | 123/606 |
| 4,217,872 | 8/1980 | Rabus et al. | 123/596 |
| 4,341,195 | 7/1982 | Nishio et al. | 123/598 |
| 4,398,526 | 8/1983 | Hamai et al. | 123/606 |
| 4,414,954 | 11/1983 | Canup | 123/606 |
| 4,428,349 | 1/1984 | Snow | 123/493 |
| 4,438,751 | 3/1984 | Iwasaki | 123/606 |
| 4,653,459 | 3/1987 | Herden | 123/637 |
| 4,887,574 | 12/1989 | Kuroiwa et al. | 123/425 |

FOREIGN PATENT DOCUMENTS

| | | | |
|---|---|---|---|
| 57-193777 | 11/1982 | Japan | 123/637 |

*Primary Examiner*—Andrew M. Dolinar

*Attorney, Agent, or Firm*—Harness, Dickey & Pierce

[57] ABSTRACT

A method and apparatus for controlling spark reignition in an internal combustion engine based on the detected luminosity or pressure in the combustion chamber is provided. Only the luminosity or pressure measurement may be used as a basis for this control. This method and apparatus is also capable of providing same cycle control of spark reignition.

23 Claims, 13 Drawing Sheets

Pressure Derivative Trigger
Lean-Idle Case - Threshold set at Mean Value

| DPTRIG | No Trigger | Trigger |
|---|---|---|
| # Pts | 45 | 55 |
| Mean | 348.070487 | 312.268964 |
| IQR | 11.376 | 37.796 |

| DPTRIGQ1 | No Trigger | Trigger |
|---|---|---|
| # Pts | 74 | 26 |
| Mean | 341.765014 | 290.282808 |
| IQR | 15.322 | 30.335 |

Pattern Recognition Trigger
Lean-Idle Case - Threshold set at
Average of Previous 10 Cycles

| AVE10-DP30 | No Trigger | Trigger |
|---|---|---|
| # Pts | 34 | 56 |
| Mean | 349.643882 | 314.850357 |
| IQR | 12.569 | 31.881 |

Pressure Derivative Trigger
High EGR Case - Threshold set at Mean Value

| DPTRIG | No Trigger | Trigger |
|---|---|---|
| # Pts | 48 | 54 |
| Mean | 517.814978 | 458.561556 |
| IQR | 39.596 | 70.523 |

Pressure Derivative Trigger
Ultr-Lean Case - Threshold set at Mean Value

| DPTRIG | No Trigger | Trigger |
|---|---|---|
| # Pts | 47 | 53 |
| Mean | 562.056404 | 448.124604 |
| IQR | 40.359 | 88.521 |

Run #1 Dual CS Spark
Run #2 Dual CS Spark
Run #3 Dual CS Spark
Run #4 Single CS Spark
Run #5 Single CS Spark
HC_%CS
ge 1
Conditional Spark under Ultra-Lean A/F Conditions
hc (PPM)
7500
7000
6500
6000
5500
5000
4500
4000
3500
3000
0 5 10 15 20 25 30 35 40 45 50 55 60 65 70 75 80 85 90 95 100
Percentage Conditional Spark
1500 RPM, WOT, 22.5 A/F,
320 Initial Spark Timing
350 CS Spark Timing CO_%CS
ge 1
Conditional Spark under Ultra-Lean A/F Conditions
Run #1 Dual CS Spark
Run #2 Dual CS Spark
Run #3 Dual CS Spark
Run #4 Single CS Spark
Run #5 Single CS Spark
CO (PPM)
0.120
0.118
0.116
0.114
0.112
0.110
0.108
0.106
0.104
0.102
0.100
0.098
0 5 10 15 20 25 30 35 40 45 50 55 60 65 70 75 80 85 90 95 100
Percentage Conditional Spark
1500 RPM, WOT, 22.5 A/F,
320 Initial Spark Timing
350 CS Spark Timing NOX_%CS
ge 1
Conditional Spark under Ultra-Lean A/F Conditions
Run #1 Dual CS Spark
Run #2 Dual CS Spark
Run #3 Dual CS Spark
Run #4 Single CS Spark
Run #5 Single CS Spark
nox (PPM)
160
150
140
130
120
110
100
90
80
70
60
50
0 5 10 15 20 25 30 35 40 45 50 55 60 65 70 75 80 85 90 95 100
Percentage Conditional Spark
1500 RPM, WOT, 22.5 A/F,
320 Initial Spark Timing
350 CS Spark Timing

METHOD AND APPARATUS FOR CONTROLLING SPARK IGNITION IN AN INTERNAL COMBUSTION ENGINE

BACKGROUND OF THE INVENTION

This invention relates to a method and apparatus for controlling ignition in an internal combustion engine, and more particularly to a method and apparatus for controlling spark ignition in an internal combustion engine by reignition of the combustion mixture in the combustion chamber of the engine based on sensed conditions in that chamber so as to improve combustion and to reduce cycle-to-cycle variation. This invention can be employed to improve overall engine performance or to reduce or eliminate engine misfires.

Cycle-to-cycle variations in the combustion chamber are undesirable characteristics of operating and running a spark ignition engine. The causes of these combustion variations have been attributed to variations in the air/fuel mixture, motion or turbulence (especially in the vicinity of the spark plug), fuel and air charging, and fresh air and residual mixing. The results of these combustion variations are variations in work output or indicated mean effective pressure (IMEP), combustion efficiency, and emissions on a cycle-to-cycle basis. These combustion variations can manifest themselves in a variety of ways including randomly varying misfires, slow burns, partial burns and fast burns, including knock. These phenomena are generally more evident under high throttle, high exhaust gas recirculation (EGR), low speed, low turbulence, cold start and lean air/fuel ratio engine operating conditions.

It is well known that the timing of spark ignition is important in obtaining maximum or desired efficiency and proper operating characteristics of the internal combustion engine. It is also generally, understood that the resultant combustion event is a function of ignition and early flame development, and a poor combustion event is known to be primarily a function of those conditions that are present in that individual cycle.

Control of a poor individual cycle should therefore preferably be based in large part upon the characteristics of that cycle as it develops. Accordingly, the inventors have provided a method and apparatus for detecting an impending poor cycle or misfire early in the combustion cycle, and for taking corrective action in the form of reigniting that same cycle to improve the resultant burn of that cycle, to reduce overall cycle-to-cycle variations, and to mitigate the poor effects of increased exhaust emissions and fuel consumption that would otherwise result if the impending poor cycle was not corrected.

The inventors have further determined that an impending poor cycle can be detected using only a luminosity detector which detects the luminosity of gases in the combustion chamber. The resulting luminosity signal can then be employed to determine if a poor cycle should be reignited. Alternatively, the inventors have determined that only a pressure sensor or transducer which senses the pressure in the combustion chamber can be used to detect a developing poor combustion cycle, in which case the pressure signal is used as a basis for reigniting a poor cycle. In each of these cases, the measured luminosity or pressure can be compared with a desired or expected threshold value for that measured parameter. If the comparison indicates that a poor cycle or misfire is imminent, that particular cycle can be reignited. This reignition may utilize the original spark plug, an alternate plug, multiple plugs, multiple discharges or a high energy ignition system.

The setting of the threshold will affect the percentage of cycles which are reignited and will largely depend on the objectives for which this conditional reignition strategy is employed. For example, this conditional reignition strategy can be used only to eliminate misfires, or it can be used to increase the overall engine efficiency at a specific operating condition. In the case of misfire elimination, conditional reignition or spark would be needed much less frequently (perhaps only 10% or less of the cycles) than if the objective is to increase engine efficiency. In this latter case, reignition could occur up to 100% of the time depending on the specific operating conditions of the engine. Maximum engine performance under some operating conditions will require multiple sparking of every cycle, while maximum performance under other operating conditions can be achieved with less than 100% multiple sparking. The threshold can also be set independently of the engine operating condition.

A number of patents have suggested improved ignition systems and the following patents are typical:

U.S. Pat. Nos. 3,620,201; 3,898,971; 3,926,165; 4,217,872; 4,164,912; 4,341,195; 4,653,459; 4,181,112; 4,398,526; 4,428,349; 4,438,751; 4,414,954.

However, as previously noted, the inventors have determined that the reignition of a particular cycle can be based on detected conditions in the combustion chamber during that same cycle. The inventors have also determined that only an in-cylinder luminosity measurement, or alternatively, only an in-cylinder pressure measurement can be used to detect an impending misfire or a developing poor combustion cycle and as a basis for reigniting that same cycle if required It is, therefore, a principal object of this invention to provide an improved apparatus and method for operating an internal combustion engine, wherein a luminosity detector or a pressure sensor is used to detect an impending poor cycle or misfire during that cycle, in which case that same cycle is reignited to improve combustion for that cycle. In addition, this reignition strategy can be used to improve overall engine performance or only to eliminate or reduce misfires.

It is another object of this invention to provide an improved method for operating an internal combustion engine and apparatus therefor, wherein only a luminosity detector, or alternatively, only a pressure sensor is used to detect an impending poor cycle or misfire, in which case a particular cycle is reignited to improve combustion for that particular cycle.

It is a further object of this invention to provide an improved apparatus and method for operating an internal combustion engine, wherein a particular cycle is reignited using the in-cylinder luminosity or pressure measurement to reduce the number of poor burns or misfires so as to reduce CO and unburned hydrocarbon emissions.

It is a still further object of this invention to provide an improved method and apparatus for operating an internal combustion engine which reduces the number of poor burns and misfires so as to increase work output of the engine and to improve fuel consumption.

It is yet another object of this invention to provide a method and apparatus for operating an internal combustion engine so as to reduce the number of overly fast burns by reducing the number of misfires or incomplete burns which typically precede and produce them.

It is a still further object of this invention to reduce the cycle-to-cycle variation in an internal combustion engine so as to extend the lean misfire limit, increase the EGR tolerance improve idle and cold start operation, and to permit operation of low turbulence, high volumetric efficiency, high power density engines.

SUMMARY OF THE INVENTION

A first embodiment of this invention is adapted to be embodied in a method for operating an internal combustion engine and apparatus therefor that has at least one combustion chamber, means for forming a combustible air/fuel mixture within the combustion chamber and means for igniting the air/fuel mixture. In accordance with this embodiment of the invention, the luminosity of gases in the combustion chamber are sensed or detected, a signal based on the detected luminosity is generated, and a particular combustion cycle is conditionally reignited based only on a comparison between the output signal from the luminosity detecting means and a reference threshold value so as to improve combustion for that particular cycle.

A second embodiment involves detecting the luminosity within the combustion chamber during each cycle of operation, generating an output signal based on the detected luminosity and conditionally reigniting a particular combustion cycle based on a comparison between the output signal generated from the detected luminosity during that particular combustion cycle and a reference threshold value so as to improve combustion for that particular cycle.

A third embodiment of the invention is also adapted to be embodied in a method for operating an internal combustion engine and apparatus therefor that has at least one combustion chamber, means for forming a combustible air/fuel mixture within the combustion chamber and means for igniting the air/fuel mixture. In accordance with this feature of the invention, the pressure in the combustion chamber is sensed or detected, an output signal is generated based on the sensed pressure and a particular combustion cycle is conditionally reignited based only on a comparison between the output signal from the pressure sensor and a reference threshold value so as to improve combustion for that particular cycle.

A fourth embodiment of the invention involves detecting the pressure in the combustion chamber during each cycle of operation, generating an output signal based on the detected pressure, and conditionally reigniting a particular cycle based on a comparison between the output signal generated as a result of the detected pressure during that particular combustion cycle and a reference threshold value so as to improve combustion for that particular cycle.

Each of these embodiments, and particularly the second and fourth embodiments wherein the conditional sparking is based on same cycle control will reduce CO and unburned hydrocarbon emissions, will reduce variations in IMEP, will reduce the number of fast burns, and can also be employed to reduce cycle-to-cycle variations.

DETAILED DESCRIPTION OF THE PREFERRED EMBODIMENTS

Figure 1:
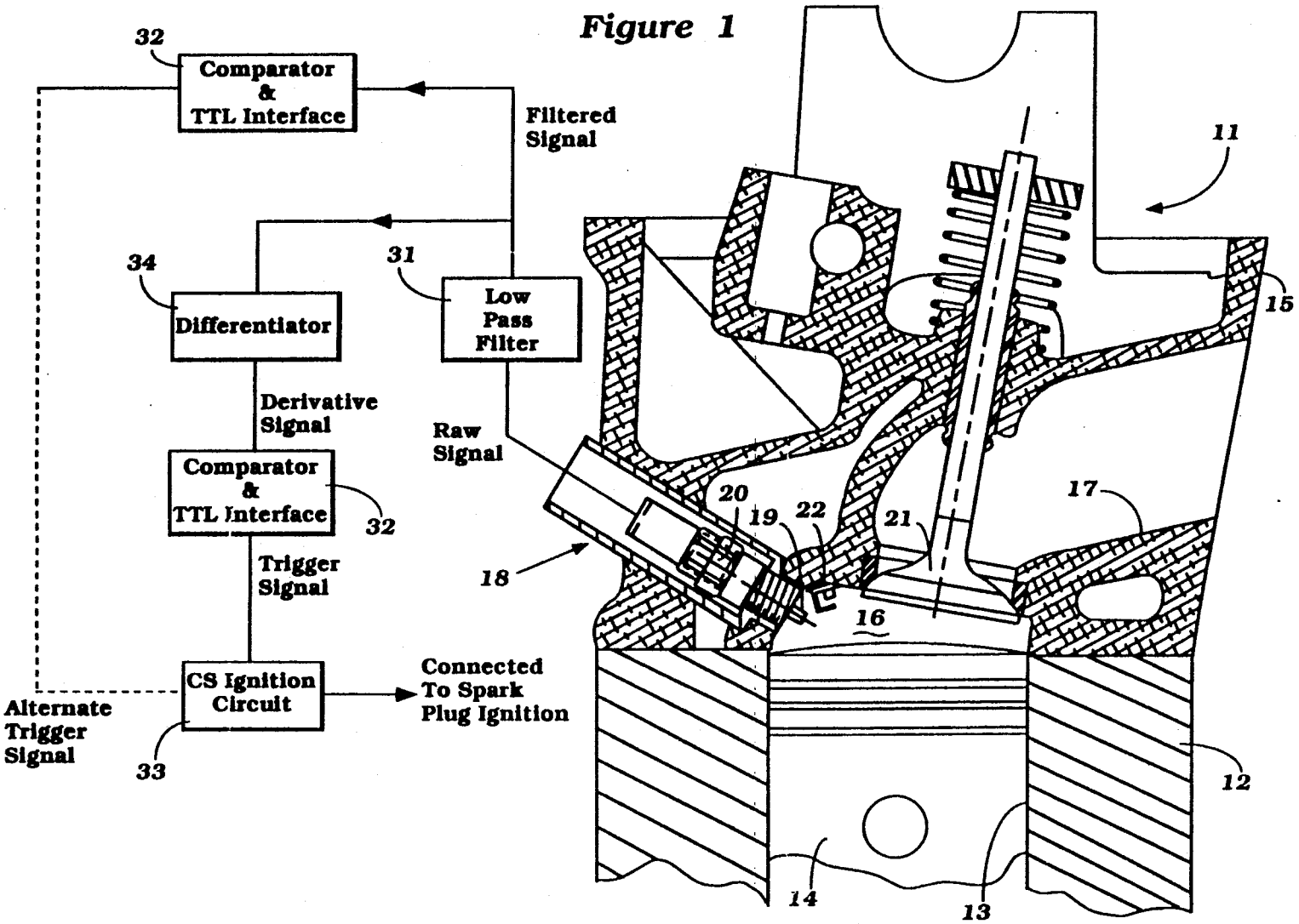
FIG. 1 illustrates a cross sectional view taken through a single combustion chamber of a multi-cylinder internal combustion engine showing a luminosity detector installed in the cylinder head and illustrating diagrammatically the processing of the luminosity signal.
Figure 2:
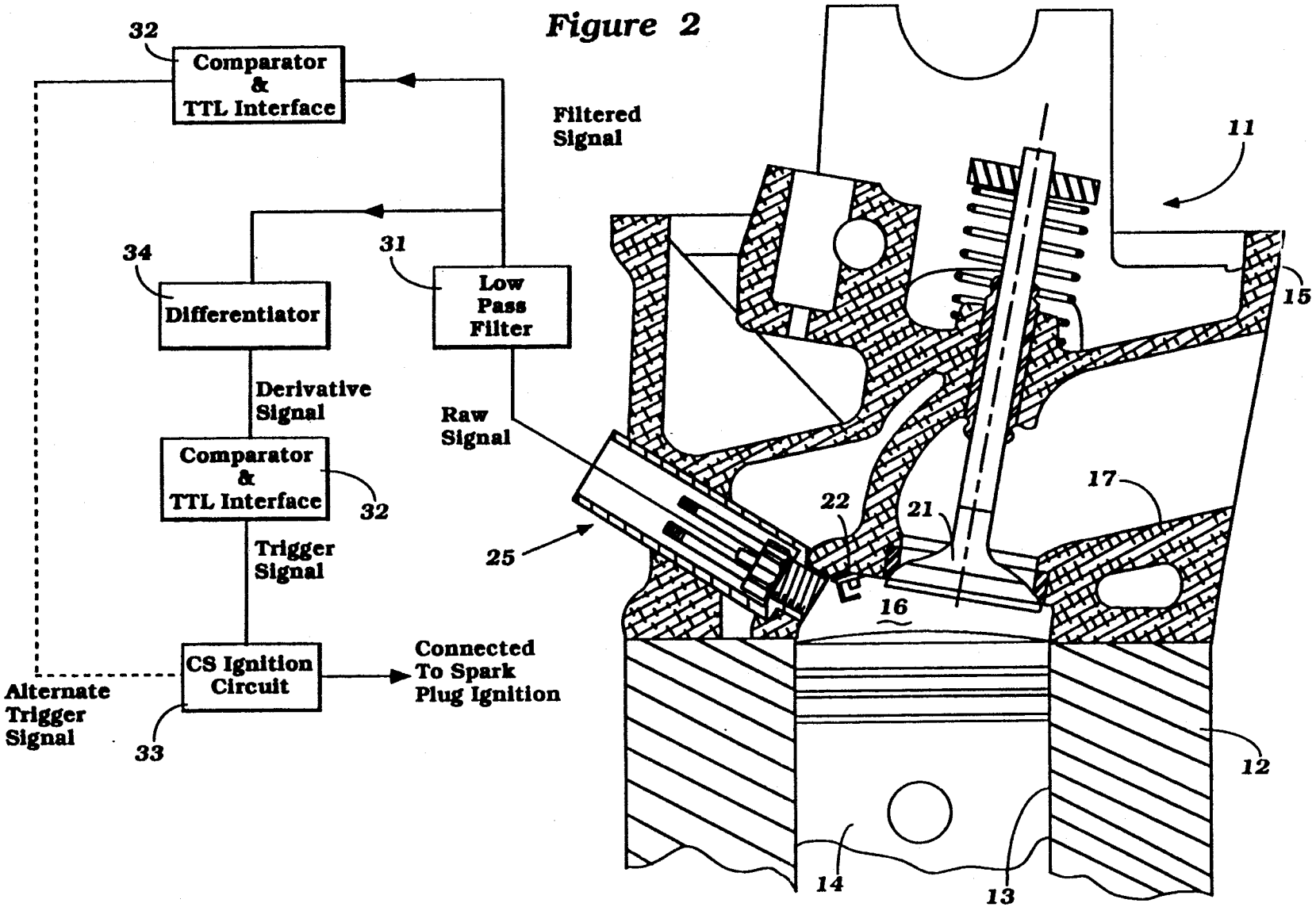
FIG. 2 illustrates a cross sectional view taken through a single combustion chamber of a multi-cylinder internal combustion engine showing a pressure transducer installed in the cylinder head and illustrating diagrammatically the processing of the pressure signal.

Referring to FIGS. 1 and 2 of the drawings, a multi-cylinder internal combustion engine is identified generally by the reference numeral 11. It is to be understood that, although the invention has particular utility in multi-cylinder engines, the invention is also applicable in single cylinder engines. Also, although the invention is described in conjunction with a reciprocating type engine, the principles of the invention may be utilized with engines of the non-reciprocating type, such as rotary engines, and with engines operating on either two stroke or four stroke cycles.

Inasmuch as the invention is concerned primarily with the combustion chamber and the conditions therein, only a cross sectional view taken through one of the combustion chambers is believed to be necessary to understand the invention. This cross sectional view shows a cylinder block 12 having a cylinder bore 13 in which a piston 14 is supported for reciprocation. The piston 14 is connected by means of a connecting rod (not shown) to a crankshaft (not shown) for providing output power from the engine.

A cylinder head 15 is affixed in a known manner to the cylinder block 12 and has a recess 16 which cooperates with the cylinder bore 13 and head of the piston 14 to provide a chamber of variable volume, sometimes referred to hereinafter as the combustion chamber.

An intake port 17 and an exhaust port (not shown) extend through the cylinder head 15 and have their communication with the combustion chamber 16 controlled by poppet type intake valves 21 for admitting a charge to the combustion chamber 16 and poppet type exhaust valves (not shown) for discharging the burnt charge from the combustion chamber 16. It is to be understood, of course, that the combustion chamber 16 may have a plurality of intake and exhaust valves and that the engine 11 may include a plurality of combustion chambers 16.

The charge admitted to the combustion chamber 16 may comprise pure air or an air/fuel mixture that is formed by a suitable charge former such as a port or throttle body type fuel injector, or carburetor. Alternatively, if pure air is delivered or injected, direct cylinder injection may be employed for delivering or injecting fuel into the combustion chamber 16 to form the air/fuel mixture. The air/fuel ratio may be controlled in a wide variety of known manners such as by means of throttle valves, fuel control valves, injector pulse width, injection duration, injection rate, etc.

The engine 11 is of the spark ignited type and a spark plug 22 or other means for igniting the air/fuel mixture is carried in the cylinder head 15 and has its gap exposed in the combustion chamber 16. The initial spark timing is controlled by a suitable mechanism which may be of any conventional type; however, spark reignition is controlled in accordance with parameters as hereinafter described.

As has been previously noted, the invention is capable of embodiment in any of a wide variety of conventional types of spark ignited internal combustion engines and, for that reason, the details of the engine construction are not necessary to understand how the invention can be practiced by those skilled in the art.

The engine used by the inventors to correlate their results was a single cylinder, port fuel injected, spark ignited engine of the side flow type having a compression ratio of 8.9, a bore of 87.7 mm, a stroke of 92.0 mm, a displacement of 0.56 liters and one intake and one exhaust valve. The engine was operated under conditions which produced high cycle-to-cycle variations and under various engine speeds, intake manifold pressures, air/fuel ratios, percent EGR, spark timing and coefficient of variation of IMEP (in percent).

Referring now to FIG. 1, in accordance with one feature of the invention, there is provided in the combustion chamber 16 a luminosity detector, indicated generally by the reference numeral 18. The luminosity detector 18 includes a fiber optic probe 19 or other type of optical access which extends through the cylinder head 15 and has its end terminating at or within the combustion chamber 16. The detector 18 and fiber optic probe 19 may be of any known type, including the type described in the application entitled "Luminosity Detector", U.S. Ser. No. 467,883, filed Jan. 22, 1990, in the names of Donald J. Remboski, et al. and assigned to the assignee of this application. The disclosure of this application is incorporated herein by reference. The probe 19 can be formed from a relatively inexpensive material such as synthetic sapphire ($Al_2O_3$) or other materials having similar characteristics. In this application, a probe having a diameter of 0.12" has been found to be practical and makes it relatively easy to install in the cylinder head.

The fiber optic probe 19 is preferably held in place by means of a compression fitting and has its outer end disposed within a light sealed housing. The probe 19 transmits luminosity from the combustion chamber 16 to a silicon photo detector 20 which may be in proximity to the luminosity detector or positioned within the luminosity detector 18. The silicon photo detector 20 outputs an electrical signal indicative of the luminosity in the combustion chamber 16.

Various luminosity spectra may be detected by the luminosity detector 18 or merely a total luminosity signal may be read. It has been found that certain constituents of the glowing gases in the combustion chamber 16 glow at different spectral ranges and this may be utilized to sense the amount of such components in the combustion chamber 16 and the combustion chamber conditions during each cycle of operation.

Those glowing gases in the combustion chamber 16 which have been found to be of particular importance in this application include OH emissions, CH emissions, and/or $H_2O$ emissions. The type of photo detector employed for the specific emissions may vary. However, if working primarily with $H_2O$ emissions there is a stronger signal and it is possible to employ a less expensive detector such as a silicon photo detector.

Also, it may be desirable to provide a monochromator or an optical filter in front of or on the silicon photo detector 20 so as to select the desired wavelength of light which is being measured. If OH emissions are being measured the wavelength should be 311.0 nm (+/−10 nm). If CH emissions are being measured, the desired wavelength is 431.5 nm (+/−10 nm). When $H_2O$ emissions are being measured, the wavelength should be 927.7 nm (+/−20 nm). These figures are exemplary only and various modifications may be employed within the scope of the invention.

Other types of luminosity detectors may also be applicable for use with the invention including those that measure flame front speed, flat arrival time or flame front shape or area.

Referring now to FIG. 2, another feature of the invention is shown and involves the use of a pressure detector or transducer 25 instead of a luminosity detector 18. This in-cylinder pressure transducer 25, is used to sense the actual pressure within the combustion chamber 16 and output an electrical signal indicative of the sensed pressure. In accordance with this feature of the invention, this pressure measurement is used as a basis for reigniting impending poor cycles or misfires.

Although a variety of luminosity and pressure detectors may be used, any sensor or detector used should be capable of fast response to the recognition circuit, particularly if a cycle is reignited based on sensed conditions in the combustion chamber 16 during that same cycle. The luminosity detector 18 and pressure transducer 25 have been found to provide adequate response time for same cycle control.

FIGS. 1 and 2 illustrate diagrammatically how the raw electrical signals from the luminosity detector 18 and pressure transducer 25 can be processed using an analog electronic system so as to control the recognition of a particular combustion cycle. Initially, the raw electrical signal generated based on the detected combustion chamber luminosity or pressure is fed through a low pass filter 31 to remove noise that may effect the performance of the electronics and cause unnecessary multiple firing of the spark plugs. If the raw but filtered signal is used, this filtered signal and a reference threshold are then fed into a comparator circuit and transistor-transistor logic (TTL) interface circuit 32. There, the filtered signal is compared against a reference threshold for determining whether a particular combustion cycle should be reignited. If the filtered signal is lower than the threshold signal, the comparator and TTL interface circuit 32 outputs a signal to the conditional spark (CS) ignition or reignition circuit 33 which is connected to the spark plug ignition for reigniting or triggering a particular cycle.

Alternatively, if the derivative of the signal is used as the trigger signal, the filtered signal is then fed into a differentiator circuit 34 where it is differentiated. This derivative signal and a reference threshold are then fed into the comparator and TTL interface circuit 32 for triggering the CS ignition circuit 33 if required. Those cycles with derivatives lower than the threshold are reignited. In addition, the outputs of both the raw but filtered signal and its derivative may be fed into the comparator and TTL interface circuit 32 for reignition only if both the raw signal and its derivative are below their respective thresholds. Other parameters of these signals can also be used to trigger reignition, such as the second derivative and second and third integrals of the signals.

The low pass filter 31 for use with this invention may of any suitable type and reference may be had to J.J. Carr, *How to Design and Build Electronic Instrumentation*, 2nd Edition, Tab Books Inc., 1986 for construction of an active low pass two poled filter with the 6 dB attenuation set at 10 kHz for use with this invention. The filter preferably includes an additional offset null circuit to produce zero output for a zero input.

The differentiator circuit 34 also may be of any suitable type and reference may be had to the above mentioned text and to W.G. Jung, *IC Op-Amp Cookbook*, Third Edition, Howard W. Sams & Co., 1986 for construction of this component. This circuit is designed with offset null capability for providing zero output for a zero rate of change in the input, and includes an additional capacitor to prevent spurious oscillations and provide stability.

The comparator and TTL interface circuit 32 for comparing the signals and interfacing with the engine control may also be of any known type. Reference may be had the aforementioned *IC Op-Amo Cookbook* for design of such a circuit. The unit is a single ended comparator with hysteresis, and is outfitted with a resistive network and offset null adjustment for precision setting of the threshold value. An arrangement for positive feedback is also included to provide hysteresis that will inhibit multiple swings of the comparator output due to noise or pressure oscillation of the pressure signal. This unit is also designed to avoid negative saturation of the operational amplifier to improve the response times to less than 10 microseconds. Zener diodes can be utilized to limit the input to the TT1 drive circuit to 0 to 5 VDC.

Although the system described herein for implementation with the luminosity detector or pressure transducer is an analog one with a constant threshold, a digital system or analog and digital hybrid could also be utilized.

In accordance with the invention, the ignition system of the engine must be capable of providing multiple sparks in short time periods. Reignition may utilize the original spark plug, an alternate spark plug or multiple spark plugs. Any of these may utilize multiple discharges or a high energy ignition system. Systems which supply higher voltage to the primary coil are well suited for use with this invention. Especially applicable are the current systems that have individual coils for each spark plug. Capacitance discharge ignition systems may also be appropriate for use with this invention. The ignition and CS or reignition circuit are believed to be within the scope of those of ordinary skill in the art once they understand that the luminosity and pressure output signals can be used as the basis for reigniting a particular combustion cycle and can also be used as a basis for same cycle control as set forth herein.

Figure 3:
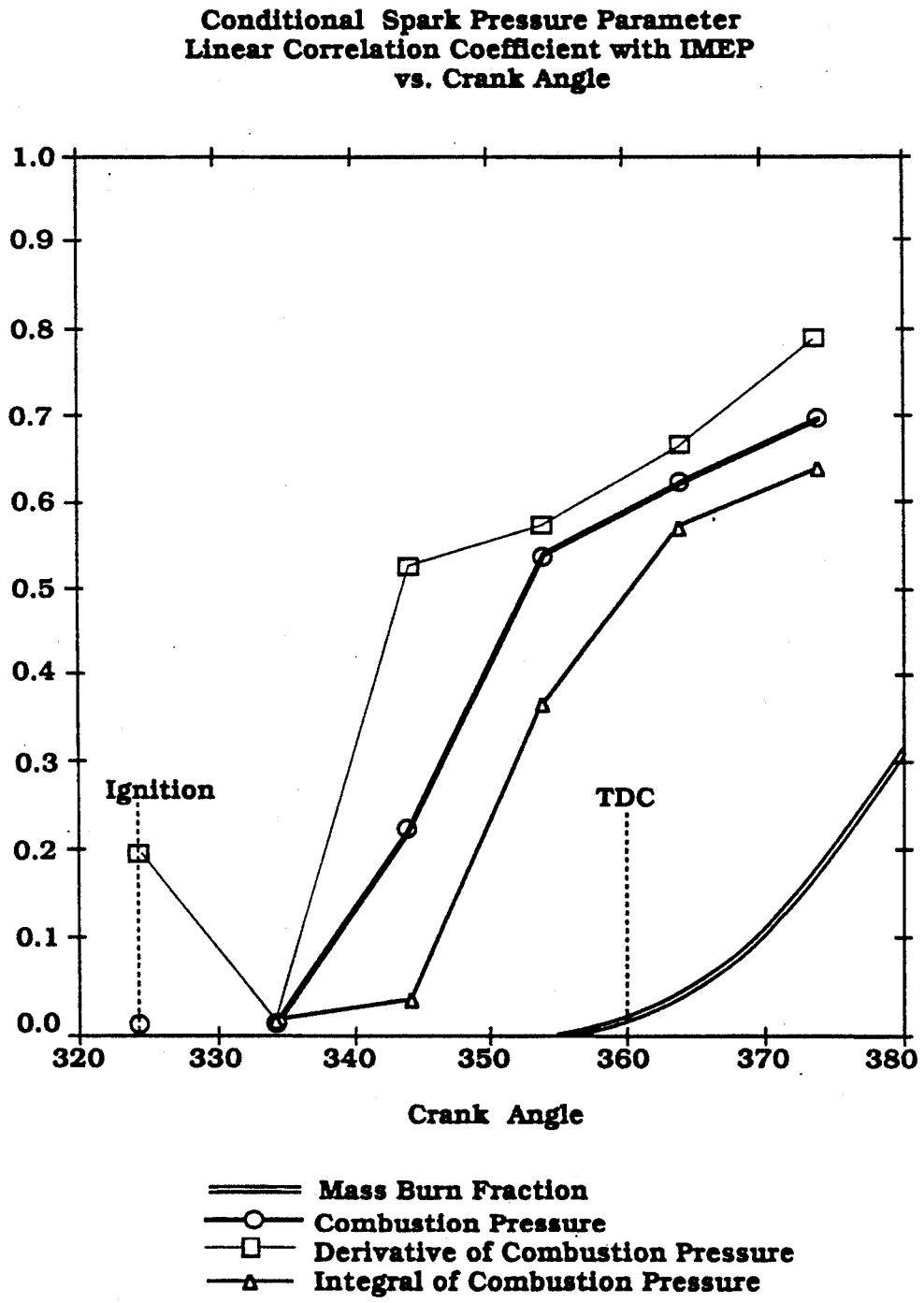
FIG. 3 shows the correlation coefficients for combustion pressure, derivative of combustion pressure and integral of combustion pressure with IMEP plotted against crank angle for the lean idle operation condition. In addition, the mass burn fraction for the ensemble average cycle is shown.

Both combustion pressure and the luminosity of various gases in the combustion chamber ($H_2O$, OH and CH) have been shown to be proportional to the combustion event and the output signals of any of these measurements as well as the various derivatives and integrals of these signals may be used to determine whether a particular cycle should be reignited or triggered. The ability of a particular parameter to perform as a conditional spark or reignition trigger signal is represented by its ability to predict low individual cycle work output (IMEP), which can be determined as the integral of pressure with respect to volume. The above luminosity and pressure signal parameters have been found to have good correlation with IMEP for purposes of determining which cycle or cycles should be reignited and therefore can be used to evaluate the overall impending quality of a cycle and to determine which cycles to reignite. FIG. 3 shows the correlation coefficients for combustion pressure, derivative of combustion pressure, and integral of combustion pressure with IMEP plotted against crank angle for the lean idle operating condition. In addition, the mass burn fraction for the 100 cycle ensemble average cycle is shown. As shown in FIG. 3, of the parameters evaluated therein, combustion pressure derivative showed the best correlation with IMEP. Correlations for all parameters improved as the cycle developed.

The timing of the conditional spark or reignition is critical; for same cycle control, recognition if required must occur early enough in the cycle to provide improvement in the thermal efficiency and emissions but late enough in the cycle to permit accurate measurement of those cycles which should be reignited. This timing may be a fixed value or may vary under different operating and engine control conditions.

Determining which cycles to reignite will depend on the particular objectives for which the recognition strategy is employed. However, it is desirable to partition the cycles into groups which reflect the quality of the cycles. For example, if improvement in overall engine performance is desired only that group or groups of cycles which show impending poor performance will be reignited. Also, for example, if only reduction or elimination of misfires is desired the partitioning will be done so that only those cycles which indicate an upcoming misfire will be reignited. In either case, this partitioning can be done by dividing the cycles into two groups of relative high and low IMEP based on the pressure and luminosity measurements. The luminosity or pressure measurements can be used as a basis for reigniting cycles with a low IMEP but not cycles with a high IMEP.

In operation, a particular parameter of the luminosity or combustion pressure output signal can be measured at a fixed time delay, for example, 30 degrees, after initial spark. This measurement can then be used to partition the cycles above and below a particular threshold for the parameter chosen. Those cycles with a lower measured value for that parameter at that timing are then reignited or triggered. Those cycles above the threshold are not reignited. As previously noted, the setting of the threshold will depend largely on the objectives of the recognition strategy and/or the engine operating conditions, and will affect the percentage of cycles which are reignited. The threshold can be set so that only impending misfires are reignited, or it can be adjusted so that a high percentage of cycles are reignited so as to improve overall engine performance. The threshold can also be set independently of engine operating conditions.

Figure 4:
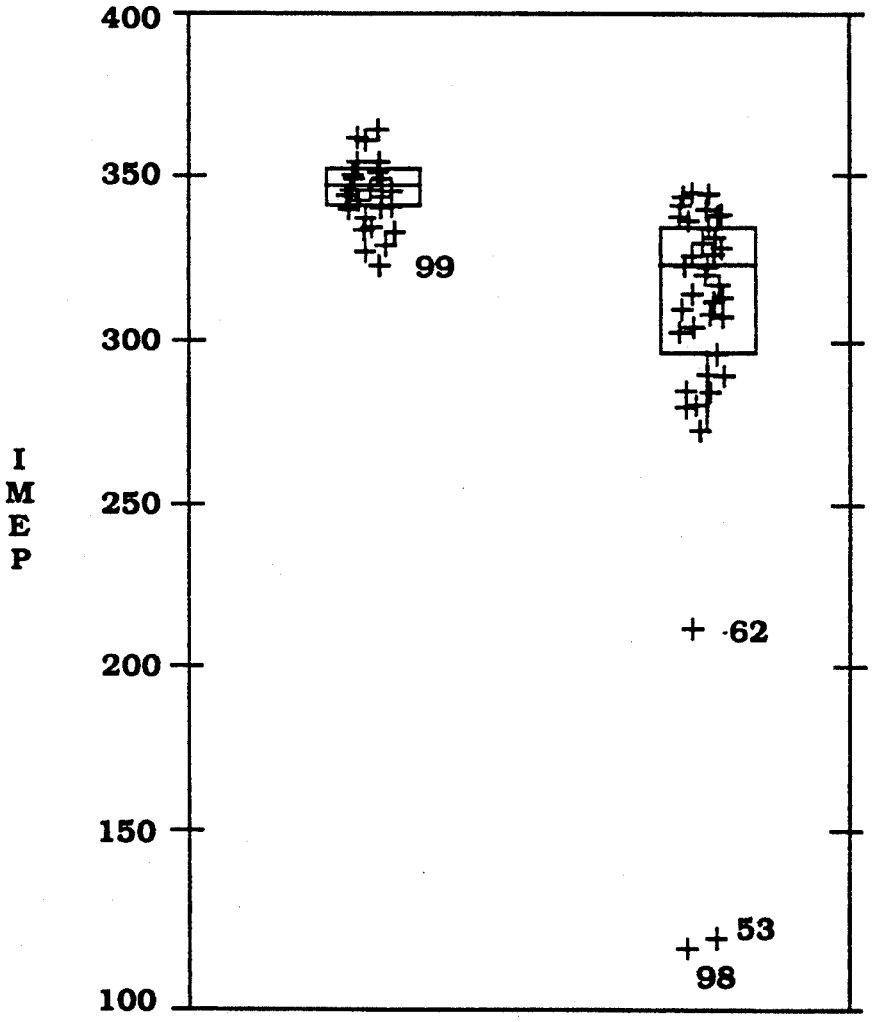
FIG. 4 shows a box plot of partitioned cycles plotted against IMEP in the lean idle case, wherein the mean value of the pressure derivative was used to determine which cycles would be reignited or triggered.

By way of example, FIG. 4 is a box plot showing a grouping of those of cycles which would be reignited or triggered and those that would not as function of IMEP determined from the combustion derivative measurement at 30 degrees after initial spark under lean idle engine operating conditions. Pressure signals were generated for 100 consecutive cycles, the derivatives of the signals were measured for each cycle, and the threshold was set at the mean value of the combustion pressure derivative measurements. IMEP was also determined based on the pressure signal. Those cycles with derivatives lower than the mean are shown on the right of the plot. These cycles are the ones that would be reignited or triggered under this partitioning technique. The cycles on the left would not be reignited. The horizontal lines through each of the boxes indicate the median IMEP value for that particular group. The top and bottom of the boxes mark the upper and lower quartiles respectively. Thus, each of the boxes show the range of half of the data points in that group. The "tails" that extend from the boxes mark either the actual range of all the data of that group, or an expected range in relation to the median and quartiles. Data points outside any expected range are shown with their cycle number. Some statistics for each group is set forth below the graph. The graph shows good partitioning of high and low IMEP cycles. Out of 100 cycles, 55 would be reignited while 45 would not. The mean IMEP value for those cycles which would be reignited was approximately 312.3 and approximately 348.1 for those cycles which would not be reignited. The inter quartile (IQR) is approximately 11.4 for the cycles which would not be reignited and approximately 37.8 for those that would be reignited. All low IMEP cycles were marked for reignition.

Figure 5:
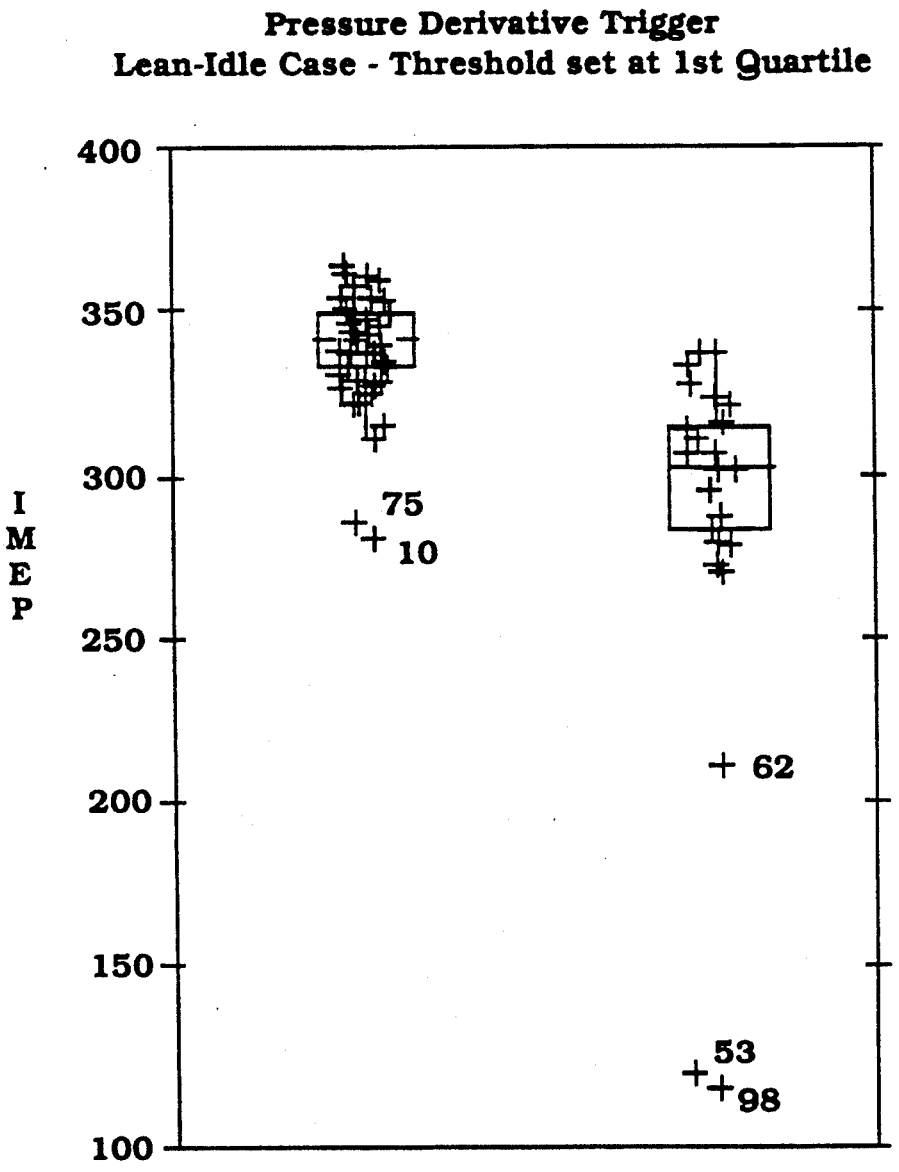
FIG. 5 shows a box plot of partitioned cycles plotted against IMEP in the lean idle case, wherein the first quartile of the pressure derivative was used to determine which cycles would be reignited or triggered.

FIG. 5 shows the results of reignition under the same conditions of FIG. 4 except that the threshold was set at the first quartile of combustion pressure derivative measurement. Using this partitioning technique, 26 out of the 100 cycles tested would be reignited or triggered. The mean IMEP value for those cycles which would be triggered is approximately 290.3 and approximately 341.8 for those cycles which would not be triggered. The IQR is approximately 15.3 for those cycles which would not be triggered and approximately 30.3 for those cycles that would be triggered. Again, all low IMEP cycles were marked for reignition.

Although the threshold can be set at a fixed value and timing as discussed above, it may be advantageous to continuously examine the cycle as it develops for an indication of an impending poor burn. Under this continuous threshold strategy, the poor cycle or misfire can be reignited as soon as the first signs of poor combustion are recognized.

Figure 6:
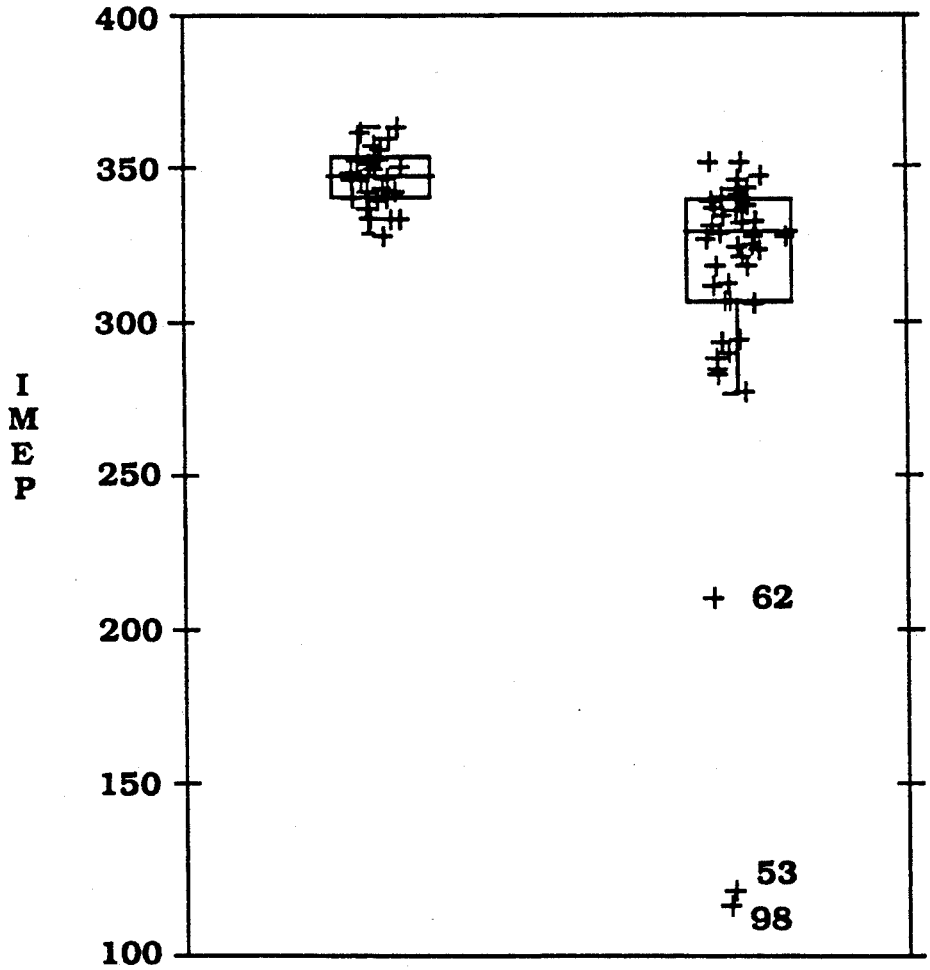
FIG. 6 shows a box plot of partitioned cycles plotted against IMEP in the lean idle case, wherein the threshold was determined based on an average of the previous ten cycles.

Pattern recognition may also be utilized to set the threshold. In this strategy, the threshold for a given cycle is a function of some number of previous cycles for example, 10 cycles. If this current cycle falls below the average threshold, the cycle will be reignited. FIG. 6 shows the results of this strategy for the same lean idle case as in FIG. 4. This pattern recognition strategy can be a simple averaging algorithm or it can take the form of a weighted average, an extrapolation, or any other suitable filtering scheme. The extrapolation strategy may be particularly useful under transient conditions. In addition, engine mapping may be avoided as the strategy continuously adjusts the trigger threshold for current conditions. Compensation for transient engine phenomena, engine aging and other long time constant engine drift phenomena may also be accomplished. Using this partitioning technique, 56 out of the 100 cycles tested would be triggered. The mean IMEP value for those cycles which would be triggered is approximately 314.9 and approximately 349.6 for those cycles which would not be triggered. The IQR is approximately 12.6 for those cycles which would not be triggered and approximately 31.9 for those cycles that would be triggered. All of the low IMEP cycles were marked for reignition.

Figure 7:
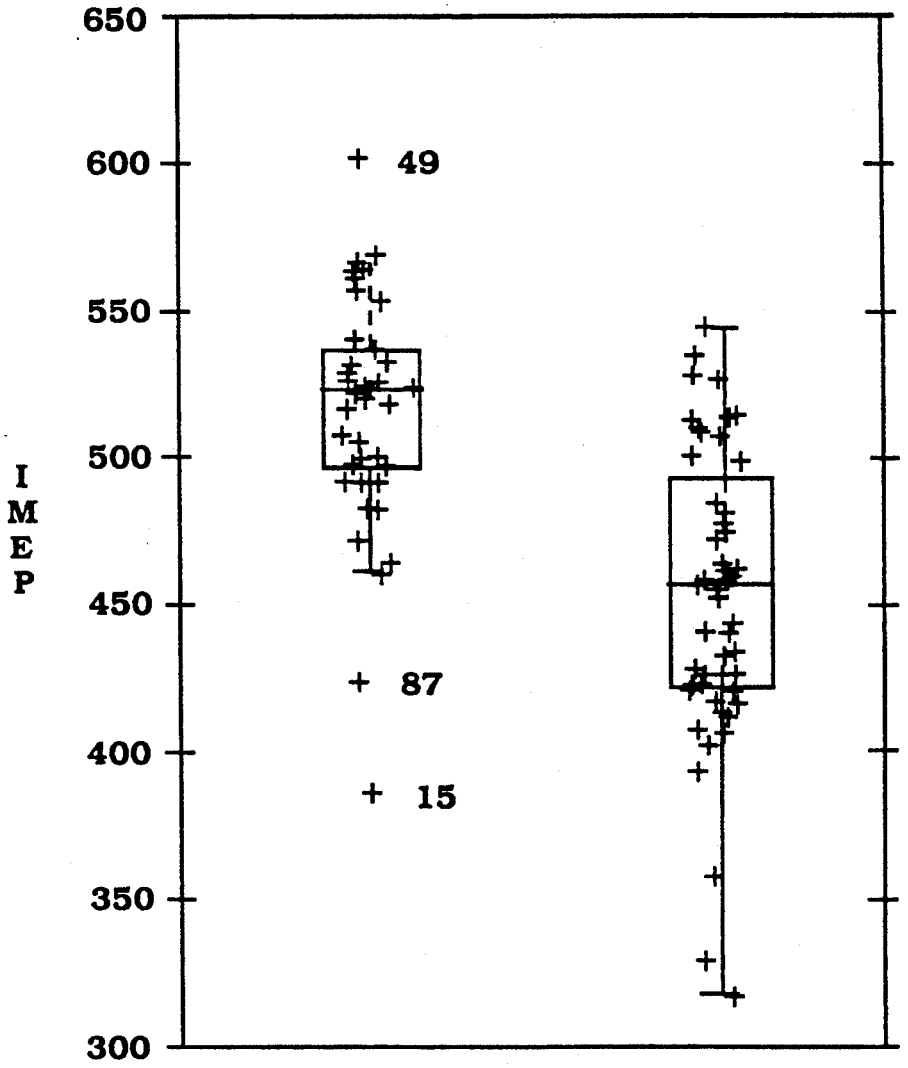
FIG. 7 shows a box plot of partitioned cycles plotted against IMEP in the high EGR case, wherein the mean value of the pressure derivative was used to determine which cycles would be reignited or triggered.
Figure 8:
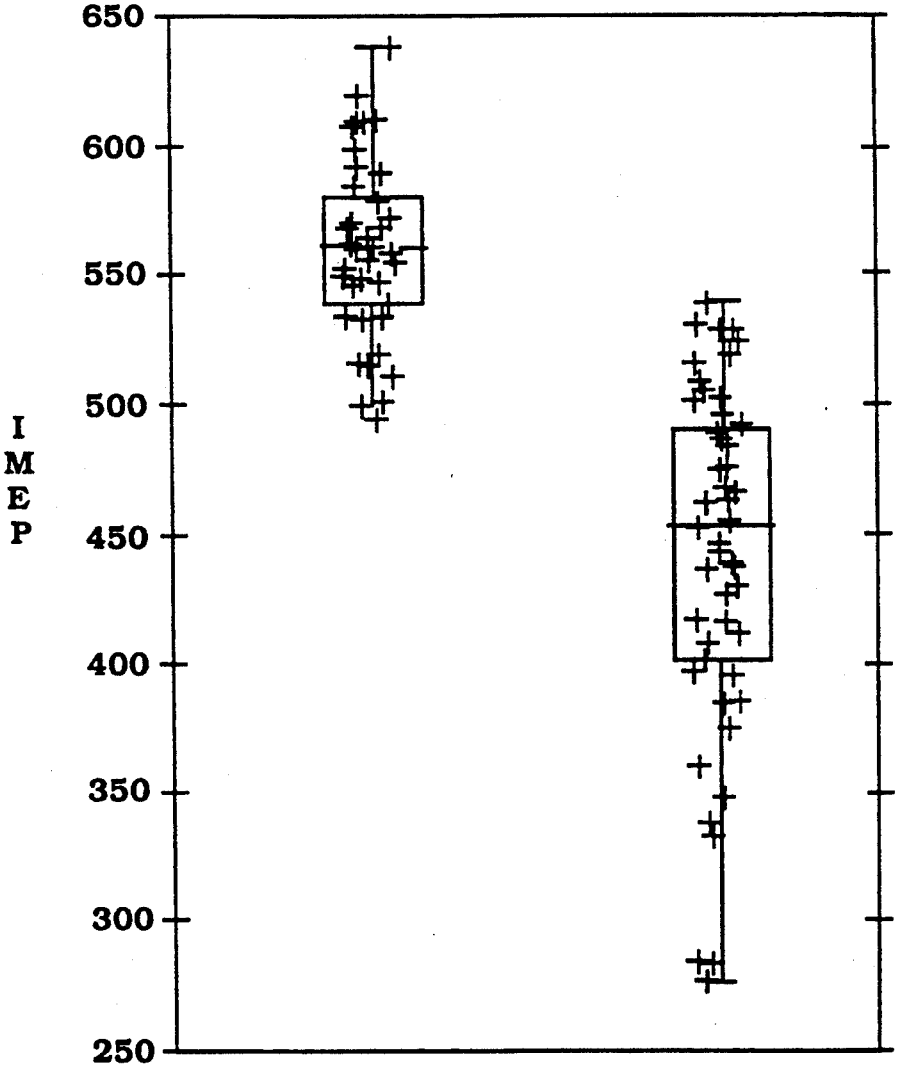
FIG. 8 shows a box plot of partitioned cycles plotted against IMEP in the ultra lean case, wherein the mean value of the pressure derivative was used to determine which cycles would be reignited or triggered.

This conditional spark or reignition strategy using same cycle control was also examined under high EGR and ultra lean operating conditions using a threshold set at the mean value of the combustion pressure derivative. The results of partitioning under these test conditions is shown in FIGS. 7 and 8 respectively.

As previously noted, the conditional spark or reignition strategy developed by the inventors can be used to reduce cycle-to-cycle variation and fuel consumption. This strategy may also be used to reduce unburned hydrocarbon and CO emissions. FIGS. 9 through 12 show the results of these correlations using both single and multiple spark plug arrangements on an engine running at 1500 rpm under wide open throttle and ultra lean air/fuel ratio conditions. Initial spark timing was set at 320 degrees and conditional spark timing at 30 degrees after initial spark. Under the multiple spark plug arrangement, one or more of the spark plugs is fired at the standard timing, and if the conditional spark strategy calls for reignition, one or more of the plugs are reignited. In the single spark plug arrangement, only a main plug is utilized.

Percentage conditional spark is defined as the percentage of combustion cycles reignited. The change in percentage was accomplished by changing the threshold in the conditional spark trigger circuit. As the threshold is increased, those cycles with the lowest derivative were triggered first.

Figure 9:
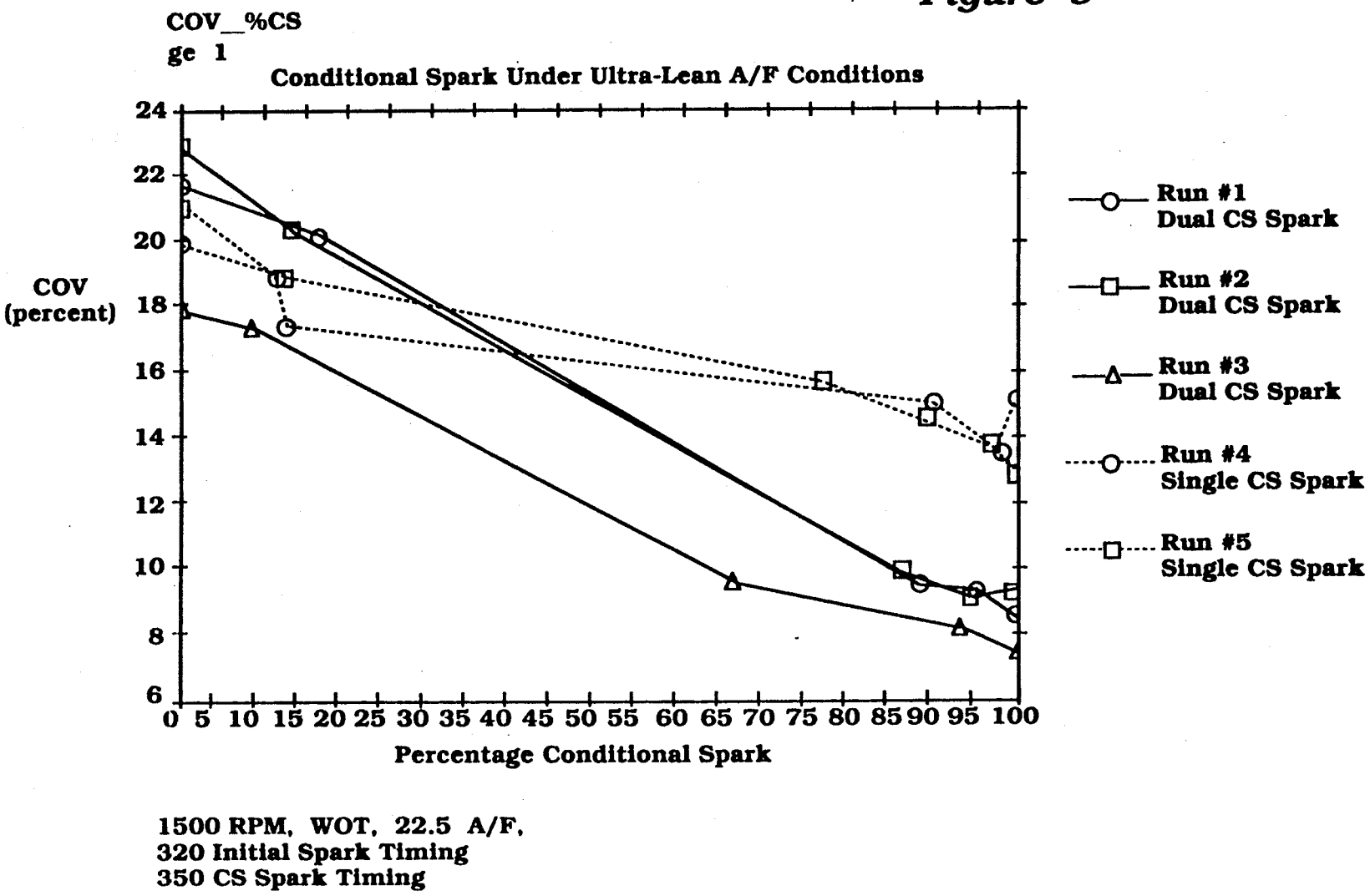
FIG. 9 shows the coefficient of variation of IMEP (cov) expressed as a percentage plotted against percentage conditional spark.
Figure 10:
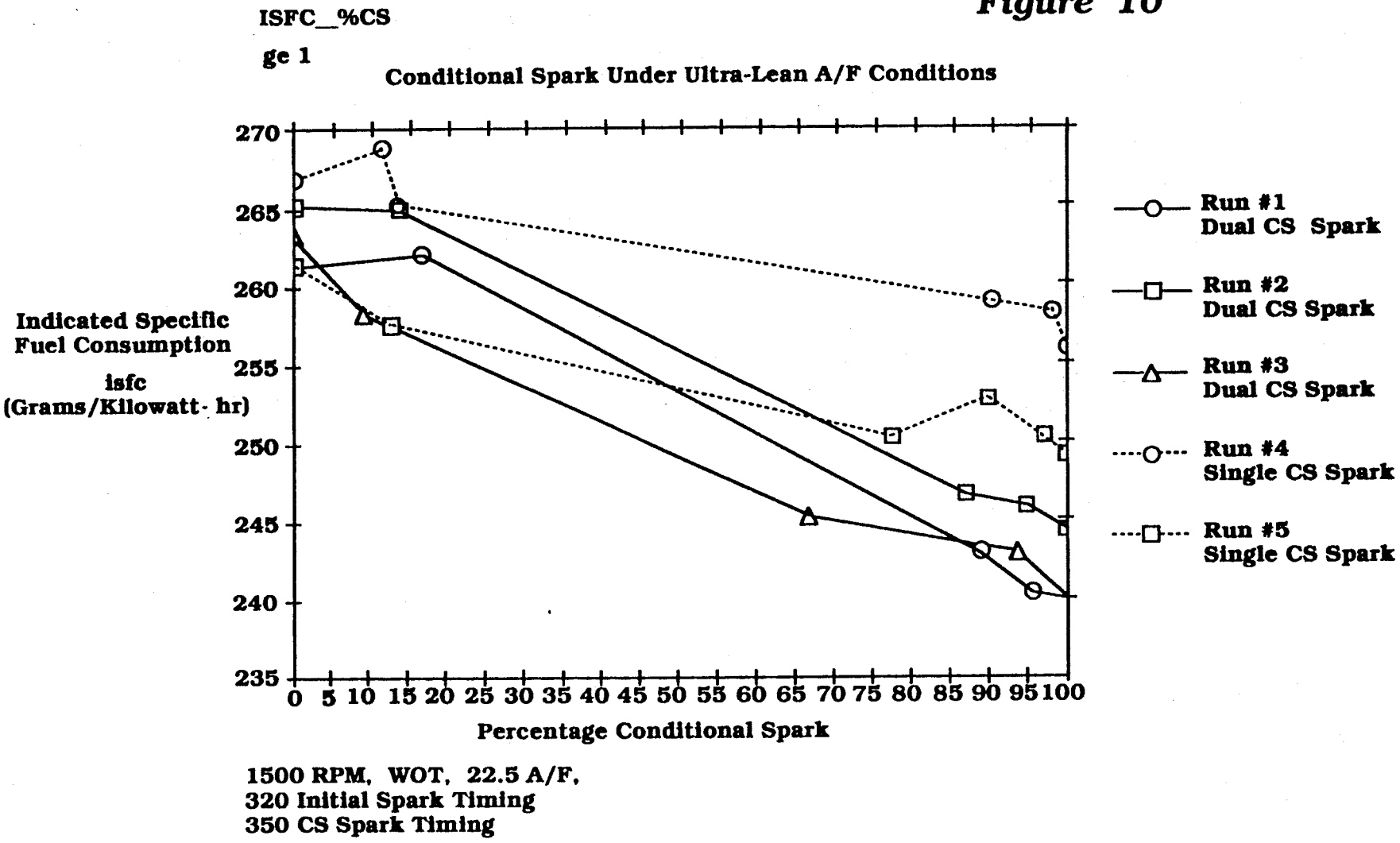
FIG. 10 shows indicated specific fuel consumption (isfc) in grams/kilowatt-hour plotted against percentage conditional spark.
Figure 11:
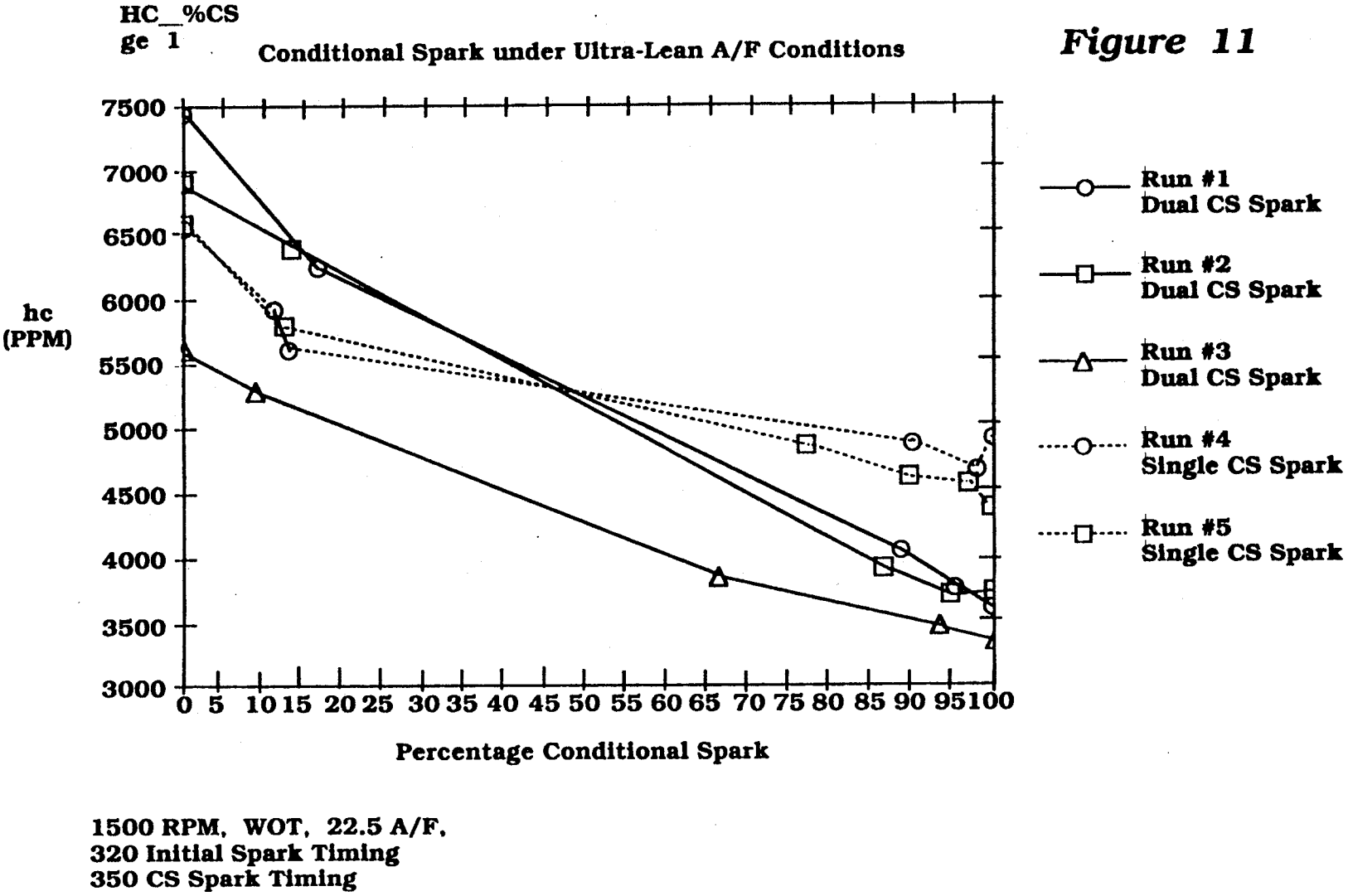
FIG. 11 shows unburned hydrocarbon emissions (hc) in parts per million plotted percentage conditional spark.
Figure 12:
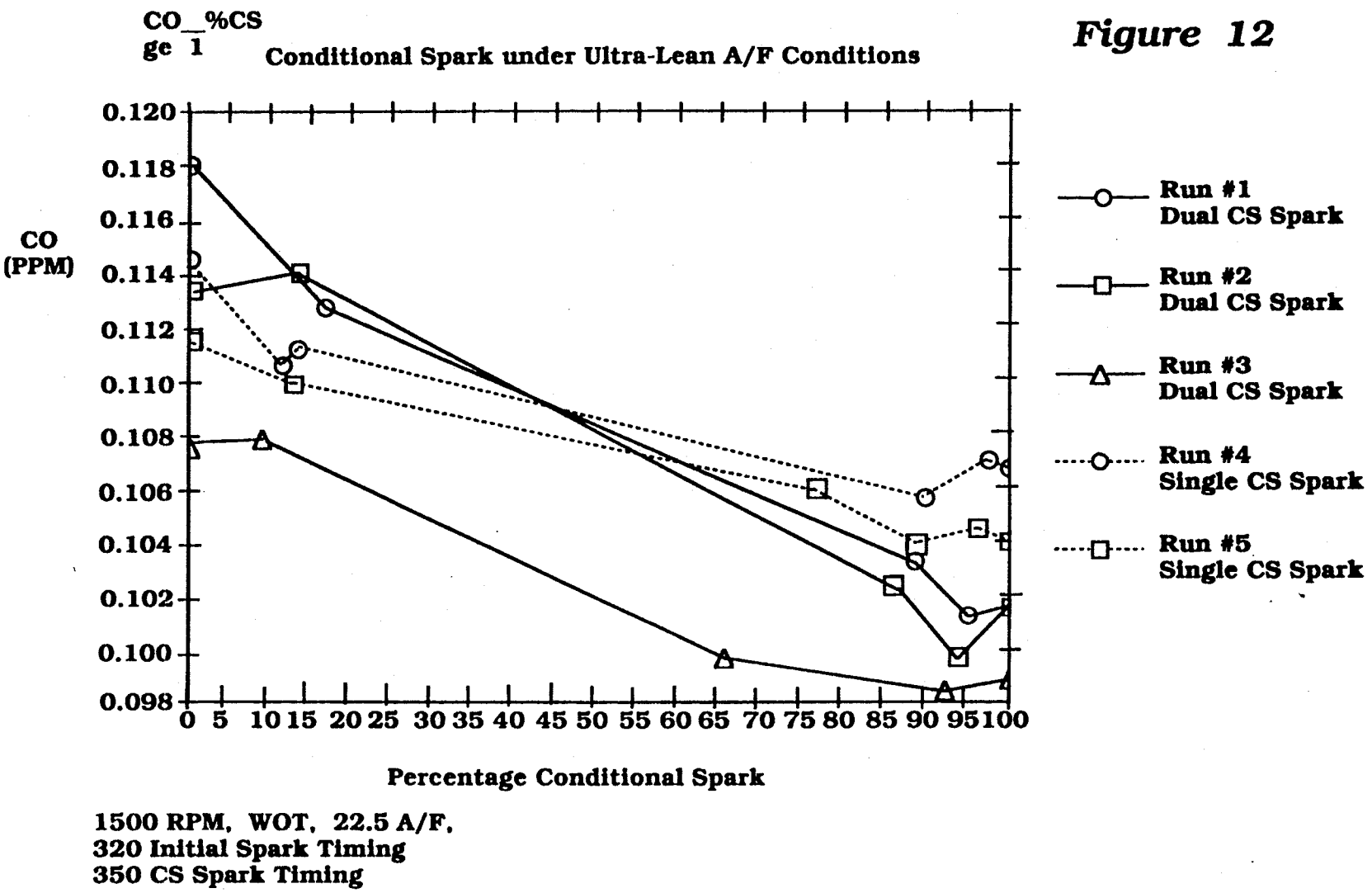
FIG. 12 shows CO emissions (co) in parts per million plotted against percentage conditional spark.

FIG. 9 shows the reduction in the coefficient of variation of IMEP (cov), which is defined as the standard deviation of IMEP divided by the mean and expressed as a percentage, as percentage conditional spark is increased. As shown in FIG. 10, reduction of cov also lead to an increase in power that reduced indicated specific fuel consumption (isfc) as percentage conditional spark was increased. FIGS. 11 and 12 show that unburned hydrocarbon (hc) and CO (co) emissions were also significantly reduced as the percentage conditional spark was increased.

Figure 13:
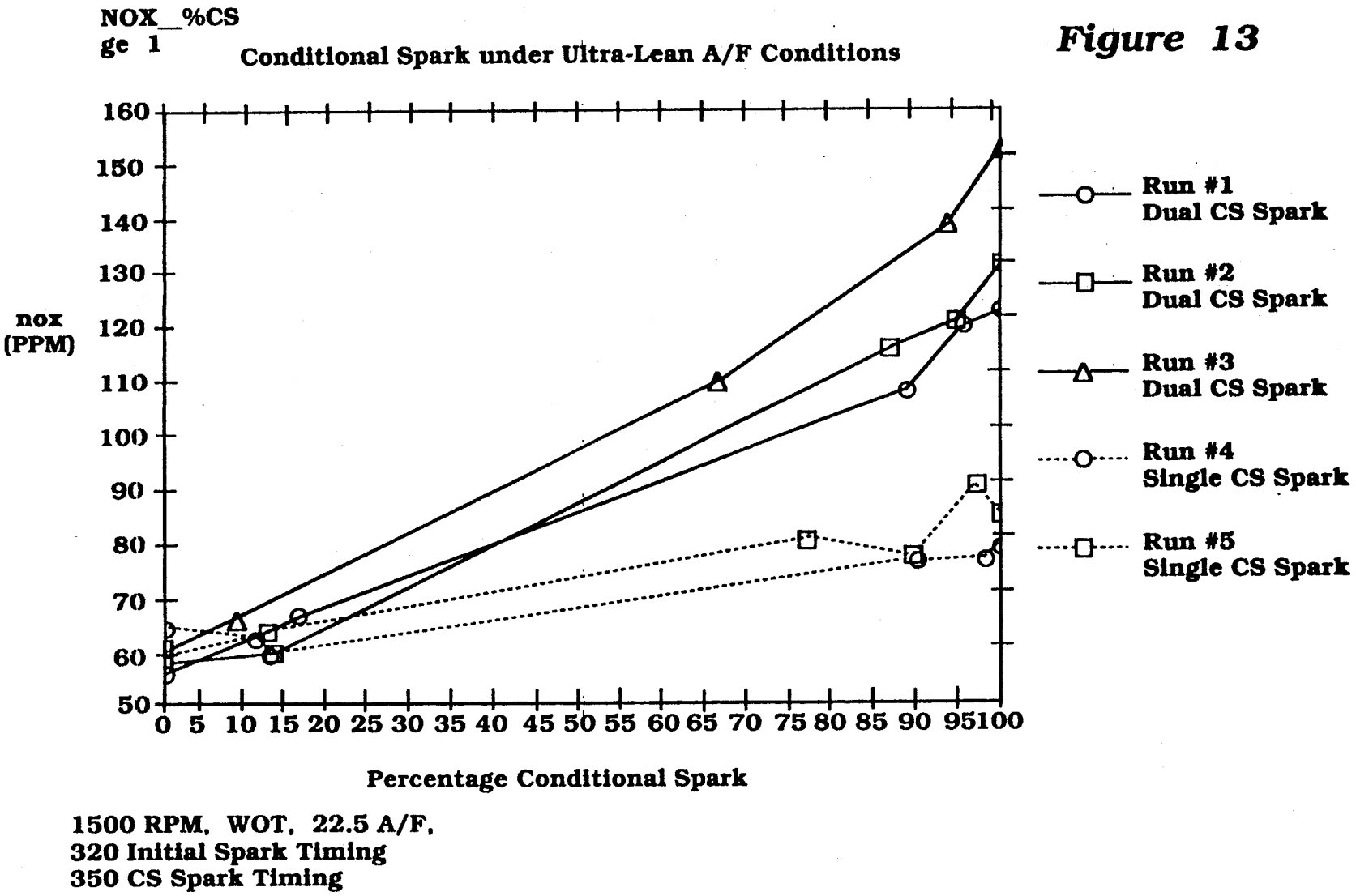
FIG. 13 shows $NO_x$ emissions (nox) in parts per million plotted against percentage conditional spark.

These graphs (FIGS. 9 through 12) indicate that various aspects of engine performance continue to improve with increasing conditional spark. Thus, while it may appear that a simpler strategy of double sparking each cycle may be a more desirable option, it should be noted that under some operating conditions 100% multiple spark may not be necessary to achieve maximum overall engine performance. Conditional sparking only a portion of the cycles also has other advantages. For example, spark plug durability may be reduced by repeated ignition on otherwise good cycles. Also, as shown in FIG. 13, $NO_x$ (nox) emissions increased with an increased percentage of conditional sparks. Thus, $NO_x$ emissions may reach a maximum acceptable level when only a portion of the cycles are reignited. In addition, reignition of fast burning cycles may increase the tendency of the engine to knock. This will reduce knock limited spark advance, compression ratio and boost, and increase octane requirement.

As previously mentioned, the percentage of conditional spark desired will depend largely on the objective for which it is employed. If only elimination of misfires is desired, the threshold can be set so that only a small percentage of cycles (10% or less) are reignited. Either same cycle control or pattern recognition as described herein could be used to accomplish this objective. The primary effects of this scheme, in addition to elimination of misfires, would be to reduce engine roughness and the deleterious effects on emissions which result from misfires.

On the other hand, the threshold could be adjusted so that a higher percentage of cycles could be reignited depending on the operating conditions or parameters of the engine to improve the overall performance or efficiency of the engine. A high percentage of multiple sparks will result in increased combustion efficiency due to more complete burns. Overall hydrocarbon emissions decrease for the same reason. $NO_x$ emissions increases with percent conditional spark; however, this scheme could be used with an appropriate type of EGR to control and maintain $NO_x$ levels within tolerable limits.

The luminosity detector 18 and its output signal can be used to determine and control certain engine operating and running conditions or parameters of the engine such a peak cylinder pressure, peak heat release rate, indicated mean effective pressure (IMEP ), air/fuel ratio, initial spark timing, etc., as described in U.S. Pat. No. 4,930,478 entitled "Method Of Operating An Engine" in the names of Steven L. Plee et al., and in the following copending applications: "Method Of Operating An Engine And Measuring Certain Operating Parameters", U.S. Ser. No. 266,682, filed Nov. 3, 1988 in the names of Steven L. Plee et al.; "Method And Apparatus For Determining Combustion Conditions And For Operating An Engine", U.S. Ser. No. 485,125, filed Feb. 26, 1990 in the names of Donald J. Remboski et al.; and "Method And Apparatus For Operating An Engine", Ser. No. 485,150, filed Feb. 26, 1990 in the names of Donald J. Remboski et al. This patent and these applications are assigned to the assignee of this application, and the disclosures of this patent and these applications are incorporated herein by reference. Other known methods may also be used for determining the engine operating and running conditions and for controlling the engine.

Mapping of engine performance including the effects of multiple sparking and percentage multiple sparking can also be used to determine when to use the conditional spark strategy to improve overall engine performance and what percentage of cycles to reignite. If this technique is used, control of conditional spark based on continuous monitoring of engine performance would not be necessary.

These techniques could also be used in connection with an engine feedback control. For example, multiple sparking could be attempted 100% of the time with reduction in the percentage if no change in engine performance occurs, or if engine knocking is detected, so as to maximize engine performance while minimizing the percentage conditional spark.

Engine mapping and feedback control could also be used in the misfire reduction strategy to conditionally spark as little as possible to achieve a minimum level of roughness or performance improvement.

As demonstrated by the foregoing description of the preferred embodiments of the invention, the in-cylinder luminosity or pressure measurement provides a very good basis for determining which combustion cycles should be reignited so as to improve combustion, reduce cycle-to-cycle variations, reduce CO and unburned hydrocarbon emissions, reduce fuel consumption or increase torque. Although that is the case, various changes and modifications may be made without departing from the spirit and scope of the invention, as defined by the appended claims.

We claim:

1. A method for operating an internal combustion engine having at least one combustion chamber, means for forming a combustible air/fuel mixture within the combustion chamber, means for igniting the air/fuel mixture within the combustion chamber, means for detecting the luminosity within the combustion chamber, generating an output signal based on the detected luminosity, conditionally reigniting a particular combustion cycle based only on a comparison between the output signal from said luminosity detecting means and a reference threshold value so as to improve combustion for that particular cycle.

2. A method for operating an internal combustion engine as recited in claim 1, wherein said luminosity detecting means detects the luminosity within the combustion chamber during each cycle of operation and a particular combustion cycle is conditionally reignited based only on a comparison between the output signal from said luminosity detecting means generated as a result of the detected luminosity during that particular combustion cycle and a reference threshold value so as to improve combustion for that particular cycle.

3. A method for operating an internal combustion engine as recited in claim 1, wherein said means for detecting the luminosity detects the luminosity of $H_2O$.

4. A method for operating an internal combustion engine as recited in claim 1, wherein said means for detecting the luminosity detects the luminosity of CH.

5. A method for operating an internal combustion engine as recited in claim 1, wherein said means for detecting the luminosity detects the luminosity of OH.

6. A method for operating an internal combustion engine having at least one combustion chamber, means for forming a combustible air/fuel mixture within the combustion chamber, means for igniting the air/fuel mixture within the combustion chamber, means for detecting the luminosity within the combustion chamber during each cycle of operation, generating an output signal based on the detected luminosity, conditionally reigniting a particular combustion cycle based on a comparison between the output signal from said luminosity detecting means generated as a result of the detected luminosity during that particular combustion cycle and a reference threshold value so as to improve combustion for that particular cycle.

7. A method for operating an internal combustion engine having at least one combustion chamber, means for forming a combustible air/fuel mixture within the combustion chamber, means for igniting the air/fuel mixture within the combustion chamber, means for detecting the pressure within the combustion chamber, generating an output signal based on the detected pressure, conditionally reigniting a particular combustion cycle based only on a comparison between the output signal from said pressure detecting means and a reference threshold value so as to improve combustion for that particular cycle.

8. A method for operating an internal combustion engine as recited in claim 7, wherein said pressure detecting means detects the pressure within the combustion chamber during each cycle of operation and a particular combustion cycle is conditionally reignited based only on a comparison between the output signal from said pressure detecting means generated as a result of the detected pressure during that particular combustion cycle and a reference threshold value so as to improve combustion for that particular combustion cycle.

9. A method for operating an internal combustion engine having at least one combustion chamber, means for forming a combustible air/fuel mixture within the combustion chamber, means for igniting the air/fuel mixture within the combustion chamber, means for detecting the pressure within the combustion chamber during each cycle of operation, generating an output signal based on the detected pressure, conditionally reigniting a particular combustion cycle based on a comparison between the output signal from said pressure detecting means generated as a result of the detected pressure during that particular combustion cycle and a reference threshold value so as to improve combustion for that particular cycle.

10. A method for operating an internal combustion engine as recited in claim 1, wherein a particular combustion cycle is conditionally reignited based only on a comparison between the output signal from said luminosity detecting means and a reference threshold value so as to reduce exhaust emissions.

11. A method for operating an internal combustion engine as recited in claim 1, wherein a particular combusiton cycle is conditionally reignited based only on a comparison between the output signal from said lumnosity detecting means and a reference threshold value so as to reduce fuel consumption.

12. A method for operating an internal combustion engine as recited in claim 1, wherein a particular combustion cycle is conditionally reignited based only on a comparison between the output signal from said luminosity detecting means and a reference threshold value so as to increase torque.

13. A method for operating an internal combustion engine as recited in claim 1, wherein a particular combustion cycle is conditionally reignited so as to reduce the number of fast burns.

14. A method for operating an internal combustion engine as recited in claim 7, wherein a particular combustion cycle is conditionally reignited based only on a comparison between the output signal from said pressure detecting means and a reference threshold value so as to reduce exhaust emissions.

15. A method for operating an internal combustion engine as recited in claim 7, wherein a particular combustion cycle is conditionally reignited based only on a comparison between the output signal from said pressure detecting means and a reference threshold value so as to reduce fuel consumption.

16. A method for operating an internal combustion engine as recited in claim 7, wherein a particular combustion cycle is conditionally reignited based only on a comparison between the output signal from said pressure detecting means and a reference threshold value so as to increase torque.

17. A method for operating an internal combustion engine as recited in claim 7, wherein a particular combustion cycle is conditionally reignited so as to reduce the number of fast burns.

18. A method for operating an internal combustion engine as recited in claim 1, wherein a particular combustion cycle is conditionally reignited based only on a comparison between the output signal from said luminosity detecting means and a reference threshold value so as to reduce cycle-to-cycle variation within the combustion chamber.

19. A method for operating an internal combustion engine as recited in claim 7, wherein a particular combustion cycle is conditionally reignited based only on a comparison between the output signal from said pressure detecting means and a reference threshold value so as to reduce cycle-to-cycle variation within the combustion chamber.

20. A method for operating an internal combustion engine as recited in claim 1, wherein a particular combustion cycle is conditionally reignited so as to reduce the number of misfires.

21. A method for operating an internal combustion engine as recited in claim 7, wherein a particular combustion cycle is conditionally reignited so as to reduce the number of misfires.

22. A method for operating an internal combustion engine having at least one combustion chamber, means for forming a combustible air/fuel mixture within the combustion chamber, means for igniting the air/fuel mixture within the combustion chamber, means for detecting the luminosity within the combustion chamber, generating an output signal based on the detected luminosity, setting a threshold value for the output signal, conditionally reigniting a particular combustion cycle only when the detected luminosity exceeds said threshold value, the setting of said threshold value being dependent on an engine operating condition so as to improve engine performance.

23. A method for operating an internal combustion engine as recited in claim 22, wherein an engine operating condition is determined based only on the detected luminosity in the combustion chamber.

* * * * *